US005947044A

United States Patent [19]

Lin et al.

[11] Patent Number: 5,947,044

[45] Date of Patent: Sep. 7, 1999

[54] PROCESS AND CONFIGURATION OF PROTRUDING EMBROIDERY

[76] Inventors: Chien-Lu Lin; Ming-Chin Chou, both of 28, Tunnel 239, Chiu Ju 1st Road, Kaohsiung, Taiwan

[21] Appl. No.: 09/021,119

[22] Filed: Feb. 10, 1998

[51] Int. Cl.[6] ..... D05C 17/00; B32B 07/08

[52] U.S. Cl. ..... 112/475.22; 112/439

[58] Field of Search ..... 112/475.22, 439, 112/475.18, 98, 99, 420, 421; 2/244; 156/90, 91, 93

[56] References Cited

U.S. PATENT DOCUMENTS

| | | | |
|---|---|---|---|
| 3,771,479 | 11/1973 | Mavis | 112/475.22 |
| 5,241,919 | 9/1993 | LaGreca | 112/439 |
| 5,832,854 | 11/1998 | Lin et al. | 112/475.22 |

FOREIGN PATENT DOCUMENTS

| | | | |
|---|---|---|---|
| 52665 | 3/1985 | Japan | 112/439 |
| 2277869 | 11/1990 | Japan | 112/439 |

*Primary Examiner*—Ismael Izaguirre
*Attorney, Agent, or Firm*—David and Raymond; Raymond Y. Chan

[57] ABSTRACT

A protruding embroidery process which is specially adapted for mass production includes the following steps. Lay and affix a filler on an embroidering background element, in which the filler is made of a kind of material that shrinks under a predetermined temperature higher than the room temperature. The filler has an even thickness of not more than 4.5 mm and a size larger than a contour size of a desired embroidering figure for covering a figure portion on the embroidering background element where the desired embroidering figure is required to embroider thereon. Entirely wrap up an embroidering portion of the filler and the embroidering background element with a plurality of sewing threads until the whole embroidering portion, including a predetermined number of side edges thereof, is entirely covered and wrapped up by the sewing threads. Fully cut off and remove a leftover portion, which is an outer portion of the filler surrounding the embroidering portion, from the embroidering portion. Heat a side periphery of the protruding embroidery to the predetermined temperature higher than the room temperature so as to cause leftover filler remnants extended out of the side periphery of the protruding embroidery shrinking within the wrapped up of the sewing threads.

22 Claims, 2 Drawing Sheets

PROCESS AND CONFIGURATION OF PROTRUDING EMBROIDERY

FIELD OF THE INVENTION

The present invention relates to embroidery, and more particularly to a process and configuration of protruding embroidery which is adequate for mass production.

BACKGROUND OF THE INVENTION

A conventional method of embroidery an embroidery with protruding figures is to provide a plurality of overlapped layers of thread. Embroidery machine embroiders a small draft as a bottom layer on a cloth or silk background element which can be processed to a quiet cover, floss silk, shoe, or a baseball cap. The background element is gradually embroidered layer by layer until a predetermined thickness of the thread layers is achieved so as to provide a protruding figure on the background element.

However, the conventional embroidering method and embroidery configurations have the following drawbacks:

(1) It can only produce a slightly protruded embroidery which is gradually raised from the edge of the embroidered figure to form a thickness of not more than 2.5 mm (2 mm to 2.5 mm) at the central portion.

(2) Since the protruded embroidery is formed with many layers of thread, it utilizes a great amount of threads and increases the cost and embroidering time. Moreover, the quality achieved is not smooth and solid enough.

(3) Many needle holes are formed on the background element that will weaken the duration and reduce the strength of the embroidery product.

Another embroidery method is a manual operation method. Craftsman cuts a hard plate, such polyvinyl chloride, according to the contour of a desired embroidering figure as a filler. The filler is placed and affixed in position on the embroidery background element. Craftsman then wraps up the filler by sewing with thread manually. Protruding embroidery figures are thus formed on the background element.

This handwork embroidery can generally achieve flat protruding embroidery figures with even thickness and precipitous edges. The maximum thickness of the protruding embroidery can be 4 mm to 4.5 mm. However, when the figure to be embroidered has a long contour side edge, the long side edge of the filler is difficult to be entirely wrapped up by the sewing thread. To some small or thin portions of the embroidery figure, it is difficult to affix the small or thin fillers in position before proceeding the embroidering work. Elegant embroidery can only be obtained by precision work of experienced craftsmen who have to spend a lot of time on superior embroidering handwork. Thus, the conventional handwork embroidery method is only adequate for articles of handicraft art where identical embroidery figures are not required. For mass production products, such as the trademarks, logos, or figures on clothing and baseball caps, identical embroidery figures are required. In view of utilization, the aforesaid handwork embroidery does not conform to the industry benefit.

SUMMARY OF THE INVENTION

It is thus a main object of the present invention to provide a process and configuration of protruding embroidery which is adequate for mass producing identical protruding embroidery products.

A further object of the present invention is to provide a process and configuration of protruding embroidery which can be utilized to embroider an embroidery figure with tiny portions.

Yet another object of the present invention is to provide a process and configuration of protruding embroidery which can effectively clear all the remnants along the side edges of the filler and produced a protruding embroidery that is near perfection.

Accordingly, the present invention provides a protruding embroidery process which comprises the following steps:

(1) Lay and affix a filler on an embroidering background element, in which the filler is made of a kind of material that shrinks under a predetermined temperature higher than the room temperature. The filler has an even thickness of not more than 4.5 mm and a size larger than a contour size of a desired embroidering figure for covering a figure portion on the embroidering background element where the desired embroidering figure is required to embroider thereon.

(2) Entirely wrap up an embroidering portion of the filler and the embroidering background element with a plurality of sewing threads until the whole embroidering portion, including a predetermined number of side edges thereof, is entirely covered and wrapped up by the sewing threads.

(3) Fully cut off and remove a leftover portion, which is an outer portion of the filler surrounding the embroidering portion, from the embroidering portion.

(4) Heat a side periphery of the protruding embroidery to the predetermined temperature higher than the room temperature so as to cause leftover filler remnants extended out of the side periphery of the protruding embroidery shrinking within the wrapped up of the sewing threads.

By means of the above disclosed process, a configuration of protruding embroidery is manufactured, which comprises an embroidering background element having a figure portion; a filler which has a predetermined embroidering figure and a thickness not more than 4.5 mm and is attached on the background element to cover the figure portion of the embroidering background element; and a plurality of sewing threads enwrapping around the embroidering figure of the filler and the figure portion of the embroidering background element, wherein the entire filler including a predetermined number of side edges thereof is entirely covered and wrapped up the sewing threads to form a protruding embroidery.

DETAIL DESCRIPTION OF THE PREFERRED EMBODIMENT

Figure 1:
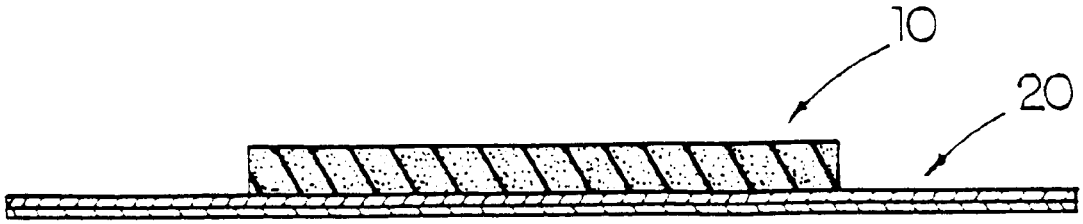
FIG. 1 is a sectional end view of a preferred embodiment of in accordance with the present invention, illustrating a filler laid on an embroidering background element.
Figure 2:
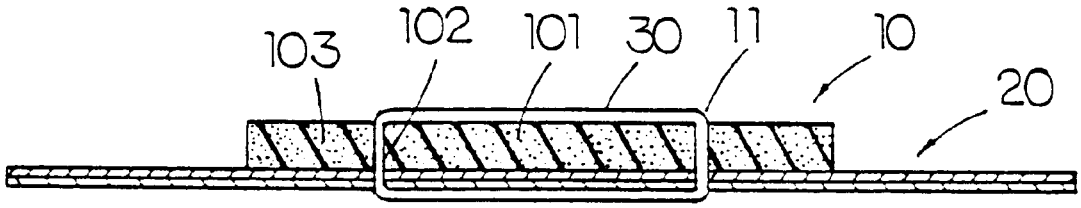
FIG. 2 is a sectional end view of the above preferred embodiment in accordance with the present invention, illustrating the embroidering of the filler and the embroidering background element.
Figure 3:
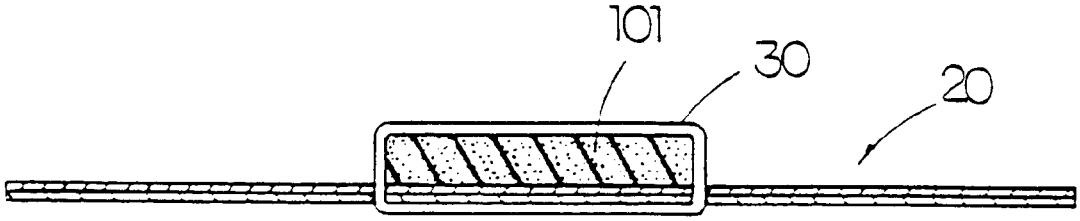
FIG. 3 is a sectional end view of a protruding embroidery manufactured by means of the process of the above preferred embodiment of the present invention.

Referring to FIGS. 1 to 3, a protruding embroidery process according to a preferred embodiment of the present invention, which comprises the following steps:

(a) As shown in FIG. 1, lay and affix a filler 10 by adhering or sewing on an embroidering background element 20, in which the filler 10 is made of a kind of material that shrinks under a predetermined temperature higher than the room temperature. The filler 10 has an even thickness of not more than 4.5 mm and a size larger than a contour size of a desired embroidering figure for covering a figure portion on the embroidering background element 20 where the desired embroidering figure is required to embroider thereon.

(b) As shown in FIG. 2, entirely wrap up an embroidering portion 103 of the filler 10 and the embroidering background element 20 with a plurality of sewing threads 30 until the whole embroidering portion 101, including a predetermined number of side edges thereof, is entirely covered and wrapped up by the sewing threads 30.

(c) As shown in FIG. 3, fully cut off and remove a leftover portion 103, which is an outer portion of the filler 10 surrounding the embroidering portion 101, from the embroidering portion 101.

(d) Heat a side periphery of the protruding embroidery to the predetermined temperature higher than the room temperature so as to cause leftover filler remnants extended out of the side periphery of the protruding embroidery shrinking within the wrapped up of the sewing threads 30.

In accordance with the above preferred embodiment, the protruding embroidery process is preferred to proceed with a numerical control (NC) embroidery machine as of conventional. The conventional NC embroidery machine generally comprises a plurality of lined up embroidery units for processing identical embroideries on several embroidering background elements respectively at one time. Each embroidery unit has an operating table surface and several needles positioned perpendicularly to the operating table surface. The needles are all threaded with threads in difference colors respectively and are preferred to be made of wear-resisting steel.

The contour of a figure which is required to embroider on the both or silk embroidering background element is input into the computer of the embroidery machine for formatting, so that the paths and the number of the needle perforating during embroidering will be calculated as numerical data. Such numerical data will be transmitted to the embroidery machine to operate the embroidering of general flat surface embroidery. Actually, the movement of needles is up and down only. The "path" of each needle means the path of the movement of the operating table in longitudinal and transversal directions.

In step (a), as shown in FIG. 1, the cloth or silk embroidering background elements are placed in position on the embroidery table surfaces of the embroidery units of the embroidery machine respectively. The filler 10 is made a kind of resilient material that would shrink when it is heated to a predetermined temperature higher than room temperature and has a low friction coefficient. The filler 10 is laid on the embroidering background element 20 in a position desired to proceed protruding embroidery figure. The filler 10 can be adhered by tape or sewed to affix on the embroidering background element 20 (just few stitches to make sure the filler 10 is affixed in position).

Figure 4:
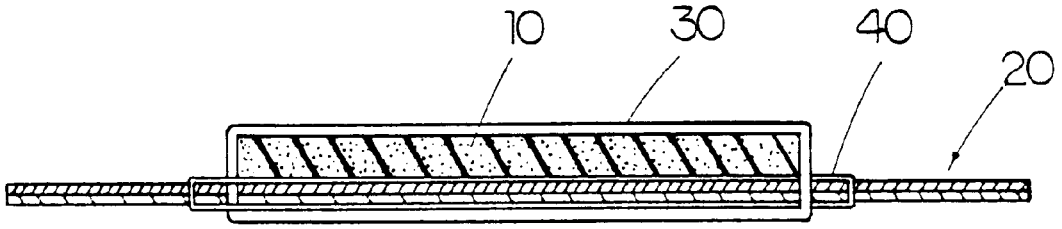
FIG. 4 is a sectional end view of a protruding embroidery with a lining embroidery underneath in accordance with the present invention.

In certain circumstances, a lining embroidery is needed to line underneath the protruding embroidery. Referring to FIG. 4, the aforesaid steps (a) to (d) are processed after a lining step of sewing a flat embroidery on the embroidering background element 20 to form a lining embroidery 40 which has a size larger than the protruding embroidery. The filler 10 is laid and affixed on the lining embroidery 40. Then the step (a) to (d) are processed.

According to the above embodiment, the use of low friction material that will shrink when heated as the filler 10 and the heating step (d) of the protruding embroidery process are the essential features of the present invention.

In fact, the leftover portion 103 of the filler 10 is torn off from the wrapped embroidering portion 101 of the filler 10 after step (c). Some leftover filler remnants will be remained between the sewing threads 30 which wraps the side edges of the filler 10. It is difficult to clear all these remnants. Even the craftsmen cut the remnants carefully and finely, only the larger remnants can be cleared and generally about eighty percent of the tiny remnants will be left over. Such coarse side edges may seriously reduce the quality of the protruding embroidery. The above defects cannot be solved even if slender needles are used for embroidering. It is because the slender needles may also damage and cut off the previous wrapped sewing threads 30 during perforating the filler 10.

However, the embroidery process of the present invention can successfully remove all leftover filler remnants and produce a protruding embroidery that is near perfection, and thus the production process not only becomes more time efficient, but also is more economically competitive.

Figure 5:
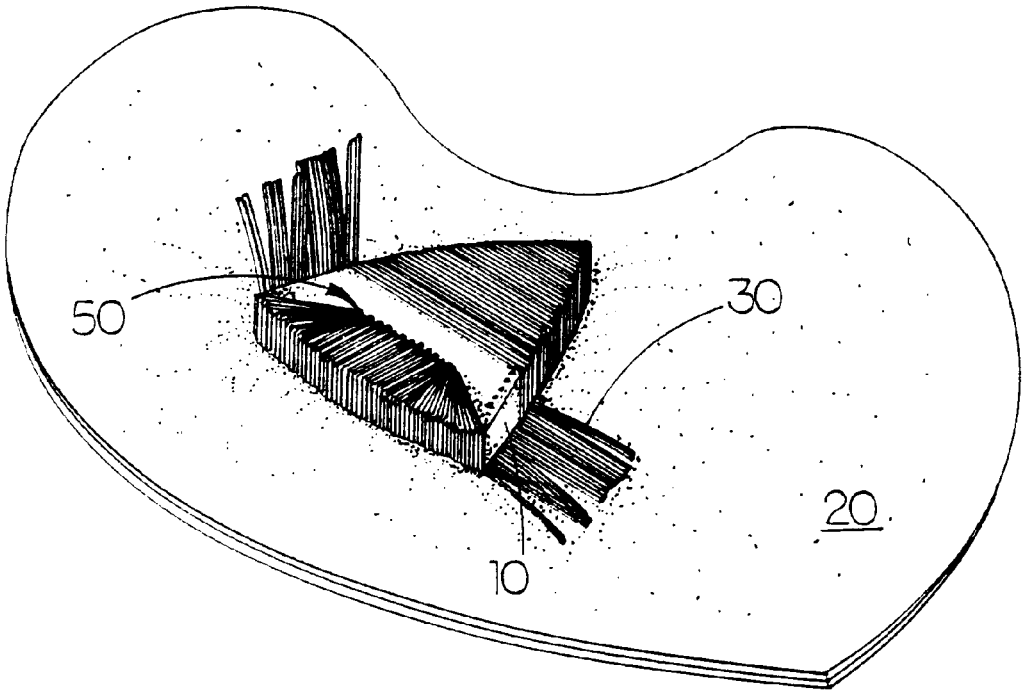
FIG. 5 is a perspective view of a protruding embroidery having portion of the wrapped threads be cut to illustrate a semi-wrapping embroidery in accordance with the present invention.

It is worth to disclose that the collapse of the comers or edges of the protruding embroidery figure, which may frequently happen in the conventional protruding embroidery, can be prevented when the protruding embroidery process of the present invention is utilized. Referring to FIG. 5, a semi-wrapping embroidering procedure is processed before the regular embroidery step (b). Such semi-wrapping embroidery 50 is processed by sewing from the side edge of the comer or the edge of the desired embroidery figure to an inner portion of the filler 10. Thus, the path of the semi-wrapped embroidery is perpendicularly to the path of the regular protruding embroidery in step (b).

It is obvious for someone skilled in art to cut the filler to desired figure first and then to lay and affix the finished filler on the embroidering background element for embroidering with the aforesaid embroidery machine. However, an embroidery figure comprises generally more than one constituent part, such as the "Adidas" logo totally consisting of seven constituent parts. Thus, it consumes too much time in filler affixing operation. Such affixing time will be several times more than the embroidering time. Furthermore, a craftsman is generally required to operate fifteen to twenty embroidery units at the same time for mass production, so that this obvious process doesn't conform to the industry benefit for utilization.

By means of the above process disclosed in the above preferred embodiment, a configuration of protruding embroidery is produced, as shown in FIGS. 3 and 5, which comprises:

- an embroidering background element 20 having a figure portion;
- a filler 10 which has a predetermined embroidering figure being attached on the embroidering background element 20 to cover the figure portion of the embroidering background element 20; and
- a plurality of sewing threads 30 enwrapping around the embroidering figure of the filler 10 and the figure portion of the embroidering background element 20, wherein the entire filler 10 including a predetermined number of side edges thereof is entirely covered and wrapped up the sewing threads 30 to form a protruding embroidery.

Moreover, as shown in FIG. 4, a lining embroidery 40 which has a size larger than the protruding embroidery can be provided between the filler 10 and the embroidering background element 20. Also, as shown in FIG. 5, a semi-wrapping embroidery 50 can be provided at a side edge of the filler 10 by sewing from the side edge to an inner portion of the filler 10 with the sewing threads 30. Besides, the filler 10 is preferable to have an even thickness of not more than 4.5 mm and is attached to the embroidering background element 20 by adhering with tape or sewing with a few stitches. Furthermore, the filler 10 can also be made of a specific material that has a low friction coefficient and a special characteristic which would shrink when it is heated to the temperature higher than room temperature.

What is claimed is:

1. A protruding embroidery process, comprising the steps of:

(a) laying and affixing a filler on an embroidering background element, in which said filler is made of a material which shrinks under a predetermined temperature higher than a room temperature and has a size larger than a contour size of a desired embroidering figure for covering a figure portion on said embroidering background element where said desired embroidering figure is required to embroider thereon;

(b) entirely wrapping up an embroidering portion of said filler and said embroidering background element with a plurality of sewing threads until said whole embroidering portion, including a predetermined number of side edges thereof, is entirely covered and wrapped up with said sewing threads;

(c) cutting off and removing a leftover portion, which is an outer portion of said filler surrounding said embroidering portion, from said embroidering portion of said filler to form a protruding embroidery on said embroidering background element; and (d) heating a side periphery of said protruding embroidery to said predetermined temperature higher than said room temperature so as to cause leftover filler remnants extended out of said side periphery of said protruding embroidery shrinking within said wrapped up of the sewing threads.

2. A protruding embroidery process, as recited in claim 1, wherein said filler has a low friction coefficient.

3. A protruding embroidery process, as recited claim 2, wherein said filler has an even thickness of not more than 4.5 mm.

4. A protruding embroidery process, as recited in claim 2, before step (a) further comprising an additional step of sewing a flat embroidery on said embroidering background element to form a lining embroidery which has a size larger than said protruding embroidery, wherein said filler is laid and affixed on said lining embroidery.

5. A protruding embroidery process, as recited in claim 4, in step (b), further comprising the step of semi-wrapping at least a side edge of said desired embroidery figure by sewing with said sewing threads to form a semi-wrapping embroidery.

6. A protruding embroidery process, as recited in claim 5, wherein said filler has an even thickness of not more than 4.5 mm.

7. A protruding embroidery process, as recited in claim 5, wherein, in step (a), said filler is adhered by tape on said embroidering background element.

8. A protruding embroidery process, as recited in claim 5, wherein, in step (a), said filler is sewed by a few stitches to affix on said embroidery background element.

9. A protruding embroidery process, as recited in claim 1, in step (b), further comprising the step of semi-wrapping at least a side edge of said desired embroidery figure by sewing with said sewing threads to form a semi-wrapping embroidery.

10. A protruding embroidery process, as recited in claim 2, in step (b), further comprising the step of semi-wrapping at least a side edge of said desired embroidery figure by sewing with said sewing threads to form a semi-wrapping embroidery.

11. A protruding embroidery process, as recited in claim 10, wherein, in step (a), said filler is adhered by tape on said embroidering background element.

12. A protruding embroidery process, as recited in claim 10, wherein, in step (a), said filler is sewed by a few stitches to affix on said embroidery background element.

13. A protruding embroidery process, as recited in claim 1, wherein said filler has an even thickness of not more than 4.5 mm.

14. A protruding embroidery process, as recited in claim 1, before step (a) further comprising an additional step of sewing a flat embroidery on said embroidering background element to form a lining embroidery which has a size larger than said protruding embroidery, wherein said filler is laid and affixed on said lining embroidery.

15. A protruding embroidery process, as recited in claim 14, in step (b), further comprising the step of semi-wrapping at least a side edge of said desired embroidery figure by sewing with said sewing threads to form a semi-wrapping embroidery.

16. A protruding embroidery process, as recited in claim 1, wherein, in step (a), said filler is adhered by tape on said embroidering background element.

17. A protruding embroidery process, as recited in claim 1, wherein, in step (a), said filler is sewed by a few stitches to affix on said embroidery background element.

18. A protruding embroidery, comprising:

an embroidery background element having a figure portion;

a filler made of a material having a low friction coefficient and shrinks under a predetermined temperature higher than a room temperature, wherein said filler has a predetermined embroidering figure and is attached on said background element to cover said figure portion of said embroidery background;

a plurality of sewing threads enwrapping around said embroidery figure of said filler and said figure portion of said embroidering background element, wherein said entire including a predetermined number of side edges thereof is entirely covered and wrapped up said sewing threads to form said protruding embroidery.

19. A protruding embroidery, as recited in claim 18, further comprising a lining embroidery, which has a size larger than said protruding embroidery, provided between said filler and said embroidering background element.

20. A protruding embroidery, as recited in claim 19, wherein a semi-wrapping embroidery is provided at a side edge of said filler by sewing from said side edge to an inner portion of said filler with said sewing threads.

21. A protruding embroidery, as recited in claim 18, wherein a semi-wrapping embroidery is provided at a side edge of said filler by sewing from said side edge to an inner portion of said filler with said sewing threads.

22. A protruding embroidery, as recited in claim 18, wherein said filler has an even thickness of not more than 4.5 mm.

* * * * *